US006558033B1

(12) United States Patent
Ruuttu et al.

(10) Patent No.: US 6,558,033 B1
(45) Date of Patent: May 6, 2003

(54) SHOCKABSORBED LAMP AND METHOD FOR MANUFACTURING OF THE SHOCKABSORBED LAMP

(76) Inventors: Jari Ruuttu, Ruukintie 4, FIN-10330 Billnäs (FI); Filip Törnroos, Sirkkalankatu 24 C 15-17, FIN-20700 Turku (FI)

( * ) Notice: Subject to any disclaimer, the term of this patent is extended or adjusted under 35 U.S.C. 154(b) by 0 days.

(21) Appl. No.: 09/700,994

(22) PCT Filed: May 21, 1999

(86) PCT No.: PCT/FI99/00441

§ 371 (c)(1),
(2), (4) Date: Feb. 14, 2001

(87) PCT Pub. No.: WO99/61837

PCT Pub. Date: Dec. 2, 1999

(30) Foreign Application Priority Data

May 22, 1998 (FI) ..... 981137

(51) Int. Cl.[7] ..... F21V 29/00

(52) U.S. Cl. ..... 362/523; 362/390; 362/519; 362/548; 362/310

(58) Field of Search ..... 362/390, 369, 362/267, 310, 523, 518, 519, 288; 445/22, 23, 26, 27, 44; 313/269

(56) References Cited

U.S. PATENT DOCUMENTS

| | | | | |
|---|---|---|---|---|
| 3,065,340 A | | 11/1962 | Mead et al. | |
| 3,067,326 A | | 12/1962 | Knapp | |
| 3,737,711 A | * | 6/1973 | Polese | 313/277 |
| 4,422,136 A | | 12/1983 | Newman et al. | |
| 5,463,541 A | * | 10/1995 | Greene | 362/369 |
| 5,491,619 A | * | 2/1996 | Gill | 362/294 |
| 5,588,288 A | * | 12/1996 | Origgi et al. | 54/82 |
| 6,148,638 A | * | 11/2000 | Oga et al. | 445/22 |
| 6,333,459 B1 | * | 12/2001 | Sato et al. | 174/35 R |

* cited by examiner

*Primary Examiner*—Sandra O'Shea
*Assistant Examiner*—Anabel Ton
(74) *Attorney, Agent, or Firm*—Burns, Doane, Swecker & Mathis, LLP

(57) ABSTRACT

The invention relates to a novel vibration proof lamp unit meant especially for demanding operating conditions. The invention relates also to a method for manufacturing the vibration proof lamp unit. The lamp unit embodiment according to the present invention can be utilized on vehicles, such as cars, busses, trucks, farm tractors, aeroplanes or on other mobile devices.

19 Claims, 5 Drawing Sheets

SHOCKABSORBED LAMP AND METHOD FOR MANUFACTURING OF THE SHOCKABSORBED LAMP

BACKGROUND OF THE INVENTION

The present invention relates to a novel embodiment of a vibration proof lamp that is particularly intended for use under demanding operating conditions and is easier to manufacture compared with prior art embodiments. The present invention relates also to a method for manufacturing a vibration proof lamp. The present invention of a vibration proof lamp can be used on vehicles such as cars, busses, trucks, farm tractors, boats, aeroplanes or other mobile devices.

A general durability problem with lamps used on mobile devices such as motorized vehicles is that they are subject to vibrations of the vehicles. There are many reasons for the vibration. The vibration of a motor vehicle is a sum of vibrations caused by the running engine, air resistance, roughness of the road surface and also the running hydraulic motor and other vibration causing factors.

Under demanding operating conditions with e.g. mobile vehicles the source of the light in the lamp units used generally is a bulb which has an incandescent filament. In order to generate light the filament must be glowing under which condition the filament is very sensitive to all kinds of vibrations. The longer the incandescent bulb has been used the more fragile it is and the more easily the filament breaks.

The incandescent filament of the bulb used as the light source has a certain natural resonance frequency. If the frequency of the externally caused vibration is the same as the natural resonance frequency of the filament the amplitude of the vibration required to break the filament is not large.

Another stressing factor for the lamp is the heat inside the lamp unit which is generated by the incandescent bulb. If the reflecting part itself or some other part is made of e.g. plastic the heat causes damage to the construction itself or to the surface of the reflector.

In the following the prior art technique is described using the accompanying figures, in which FIG. 1 shows a lamp unit embodiment according to the prior art, FIG. 2 shows another lamp unit embodiment according to the prior art.

FIG. 1 shows the lamp unit embodiment according to the prior art. The prior art lamp unit embodiment consists of a reflector 1, a front glass 2, a seat mean 3, a bulb 4, a lamp housing 5 and resilient gaskets 6,7. The lamp unit embodiment is attached to the vehicle 9 with a bracket 8 and resilient washers 10, 11.

The reflector part 1 can be made of either plastic or metal. Plastic is used generally, because a better reflection effect is achieved by it. The front glass 2, which is in most cases glass or plastic is attached to the reflector 1. In the embodiment according to the prior art presented the resilient gasket 6 has been utilized to prevent damaging the parts 1, 2 and for absorbing the vibration.

The seat mean 3 on which the bulb 4 can be mounted and locked is attached to the reflector 1 of the lamp unit. The seat mean is usually fixedly attached to the reflector 1 with e.g. screws or locking plates.

After this the aforementioned assembly 1–4 presented is mounted inside the lamp housing member 5 so that the gasket 7 remains between the lamp housing and the aforementioned assembly. The gaskets 6, 7 prevent dirt getting into the lamp unit and their secondary function is to absorb mechanical vibrations. The reflector 1 and the front glass 2 are usually connected to the lamp housing member 5 by screws.

The lamp assembly 1–5 according to the prior art is attached to the bracket 8 using a bolt and vibration absorbing resilient washers 10, 11. The vibration absorbing washers 11 are located on both sides of the lamp housing member 5. It is also common that the inner vibration absorbing resilient washer 10 has been removed and only the washer 11 outside the lamp housing member 5 is used. The bracket 8, whereas, is fastened tightly using a bolt or a corresponding device to part 9 of the frame of the vehicle, e.g. to the bumper. The vibration of the lamp assembly 1–5 caused by air flow is not isolated by the resilient washers 10,11.

Under demanding operating conditions the prior art embodiment presented has the problem that the fastening of the bracket 8 at its both ends to the lamp housing part 5 and to the part 9 of the car must be very strong.

When the vehicle is moving the air flow causes a great torsional moment to both fixing positions as well as the different frequencies and amplitudes of the vibration. These factors make the absorption of the aforedescribed vibration difficult. However, the lamp housing part 5 itself must be fastened very firmly to the part 9 of the vehicle in order that it under usage would maintain its desired position.

In the lamp unit according to the prior art described above the heat generated by the incandescent bulb and its slow conduction out of the lamp unit causes additional problems. The heat generated damages both the reflector 1 and the lamp housing part 5.

FIG. 2 shows another lamp unit embodiment according to the prior art. The other lamp unit embodiment according to the prior art consists of a main reflector part 12, a seat mean 3 for the incandescent bulb, a front glass 2, a bulb 4, a lamp housing part 5 and vibration absorbing pads 13, 14. The purpose of the vibration absorbing pads is to absorb the adverse vibrations so that they cannot cause damage to the bulb 4 and to the seat mean of the bulb 3 through the lamp unit housing part 5, the front glass 2 and the reflector 12.

In U.S. Pat. No. 5,491,619 is also shown a lamp unit embodiment according to the prior art, which consists of a vibration and shock isolated mounting system. The lamp unit construction according to the prior art consists of a heat conducting metal element, which is positioned in heat conducting contact with the bulb. In that lamp unit construction four silicone rubber grommets or pads are placed one in each corner around the projecting center socket and the construction is locked with a locking plate to the socket. The lamp construction can be connected either to the reflector or to the lamp housing.

The greatest disadvantage of the lamp unit embodiment shown in U.S. Pat. No. 5,491,619 is that if the silicone pad is embedded in the lamp seat mean by casting so the seat mean of the bolt must be mounted separately on the sockets and must be locked using the locking plates. If the silicone grommets or pads are separate still an additional manufacturing phase is required. The presented embodiment according to the prior art requires always an additional assembly because the embedding in place by casting cannot be accomplished.

OBJECTS AND SUMMARY OF THE INVENTION

The purpose of the present invention is to produce such a vibration proof lamp unit embodiment which can be used especially under demanding operating conditions and which is easier to manufacture than the prior art embodiments and by which the problems presented above can be resolved and the draw backs can be corrected and the purpose is to show a method for manufacturing the vibration proof lamp unit in question. In order to accomplish this the vibration proof lamp unit embodiment is characterized in that the lamp unit comprises additionally a casting, vibration absorbing support posts, a seat mean of the bulb, casting channels and the protrusions of the bulb seat mean so that the seat mean of the bulb is vulcanized together with the lamp housing part by the help of the protrusions of the bulb seat mean and the vibration absorbing support posts are connected to both the lamp housing and the seat mean of the bulb by casting. In addition the method according to the present invention to manufacture a vibration proof lamp unit is characterized in that the method comprises a seat mean of the bulb, a mould for casting and a lamp housing part so that the seat mean of the bulb is placed in the mould so that the protrusions of the bulb seat mean remain between the frames of the mould, the mould is sunk to the desired depth into the lamp housing, the mould frame is cast with the casting mass, which forms through the casting channels the vibration absorbing support posts.

BRIEF DESCRIPTION OF DRAWING

In the following the invention is described in detail using the accompanying figures, in which.

DETAILED DESCRIPTION OF PREFERRED EMBODIMENTS OF THE INVENTION

Figure 1:
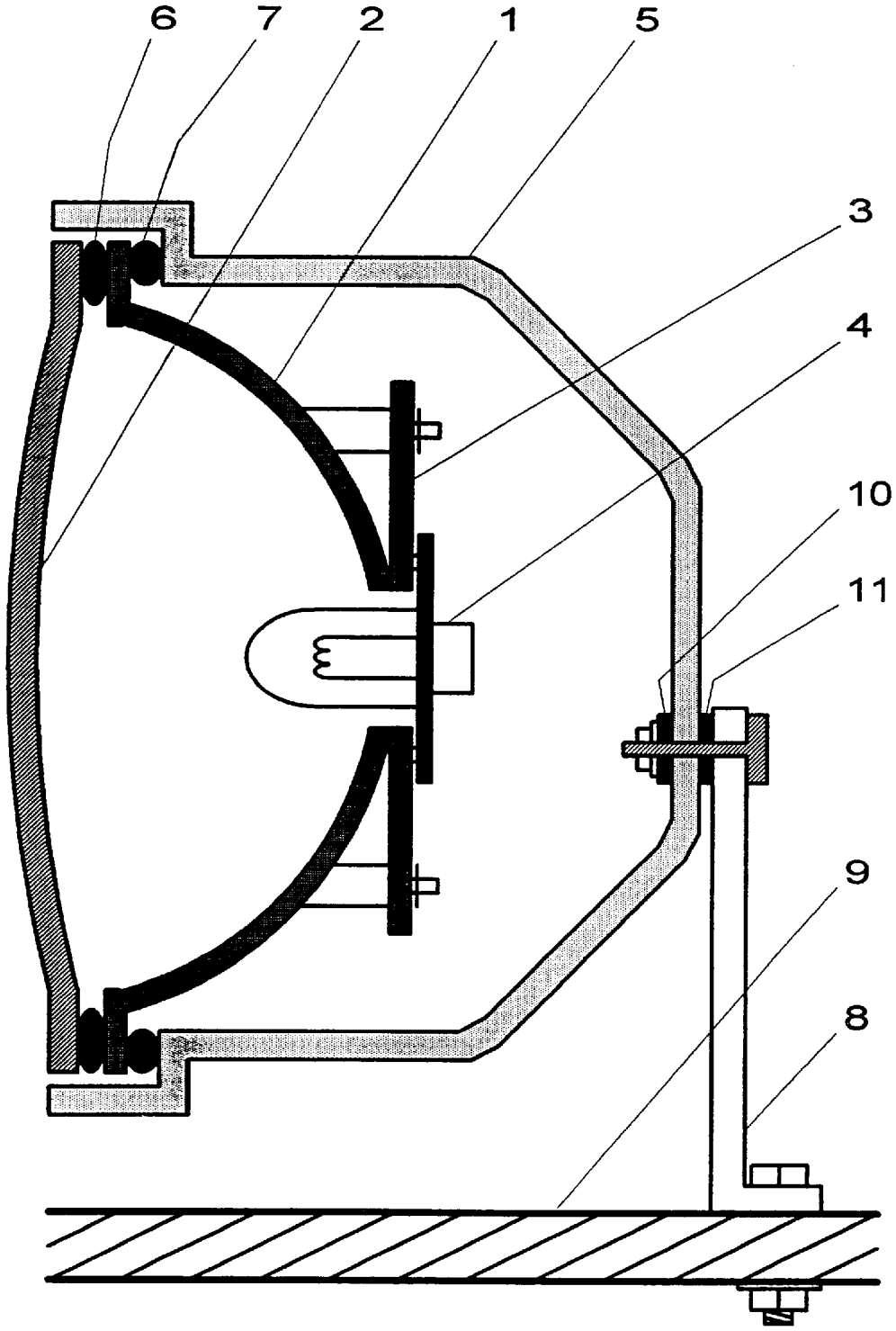
Fig. 1 PRIOR ART
FIG. 1 shows a lamp unit embodiment according to the prior art.
Figure 2:
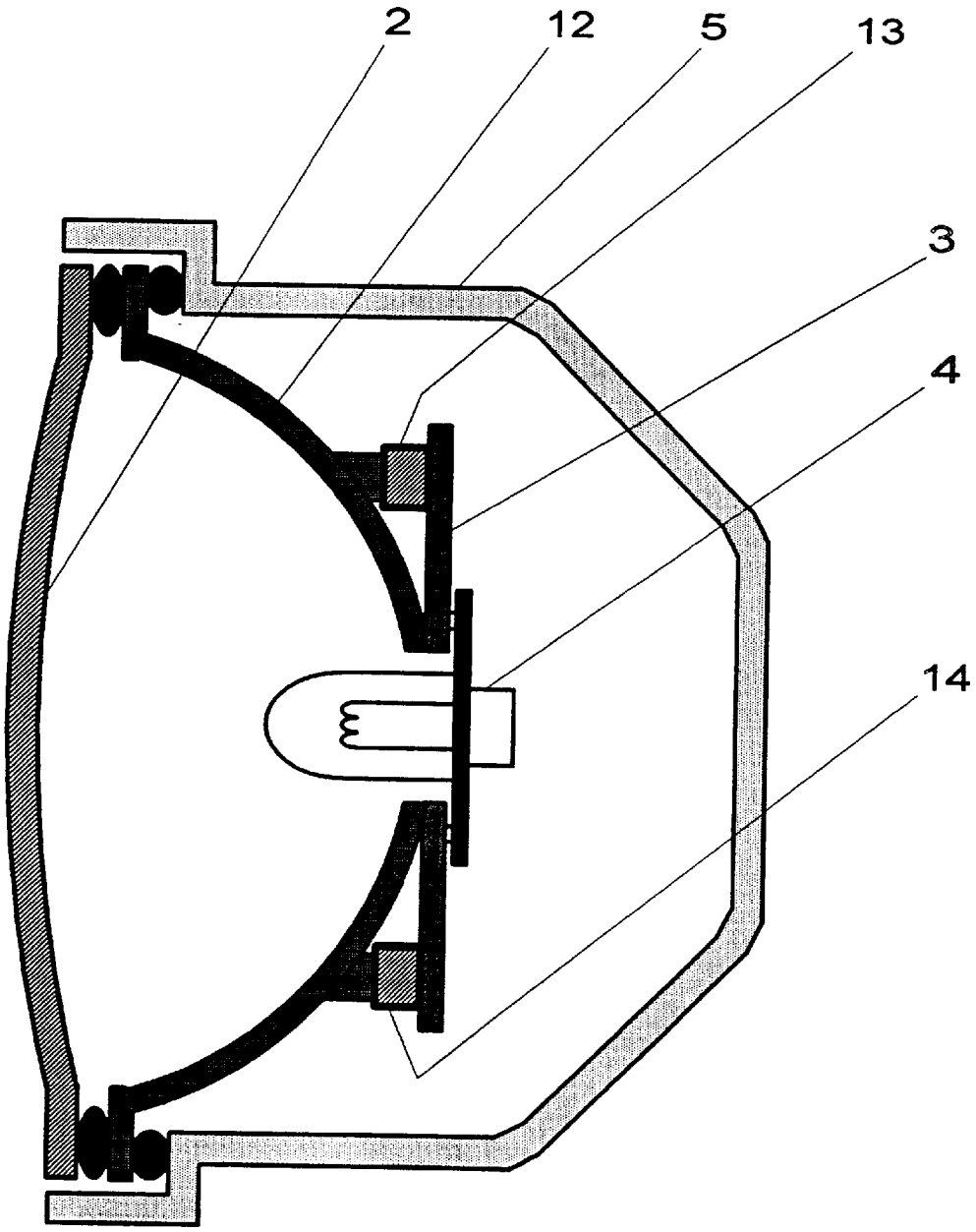
Fig. 2 PRIOR ART
FIG. 2 shows another lamp unit embodiment according to the prior art.

FIGS. 1–2 have been described above. In the following the present invention is described by referring to FIGS. 3–5, which show the implementation according to the invention.

Figure 3:
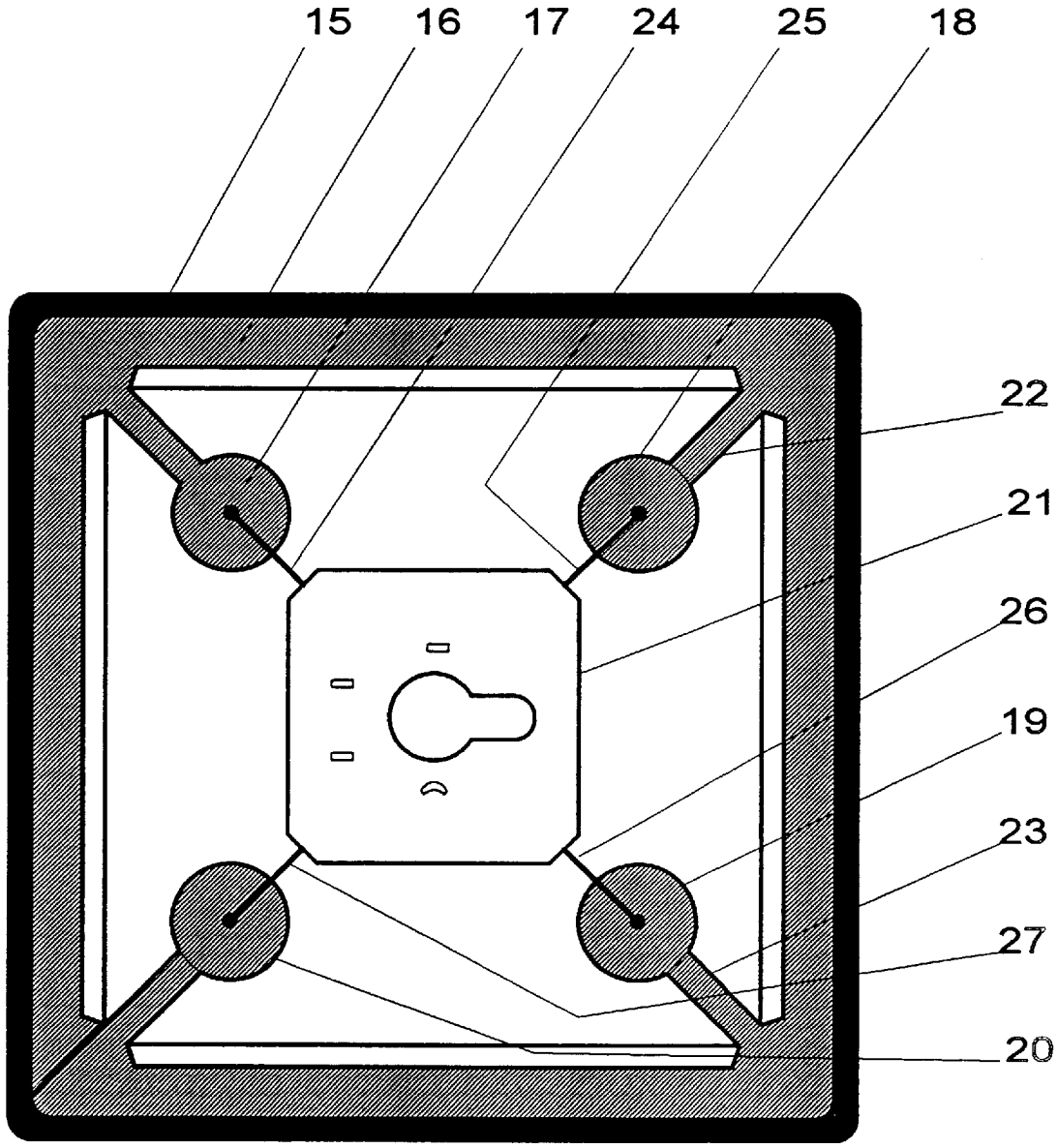
FIG. 3 shows the front view of the casting of the lamp unit embodiment according to the present invention.

FIG. 3 shows a front view of the cast parts of the lamp unit embodiment according to the invention. The lamp unit embodiment according to the invention includes an outer gasket 15, a casting 16, vibration absorbing support posts 17, 18, 19, 20, the seat mean 21 of the bulb, the casting channels 22, 23 and the protrusions 24, 25, 26, 27 of the bulb seat mean.

Figure 4:
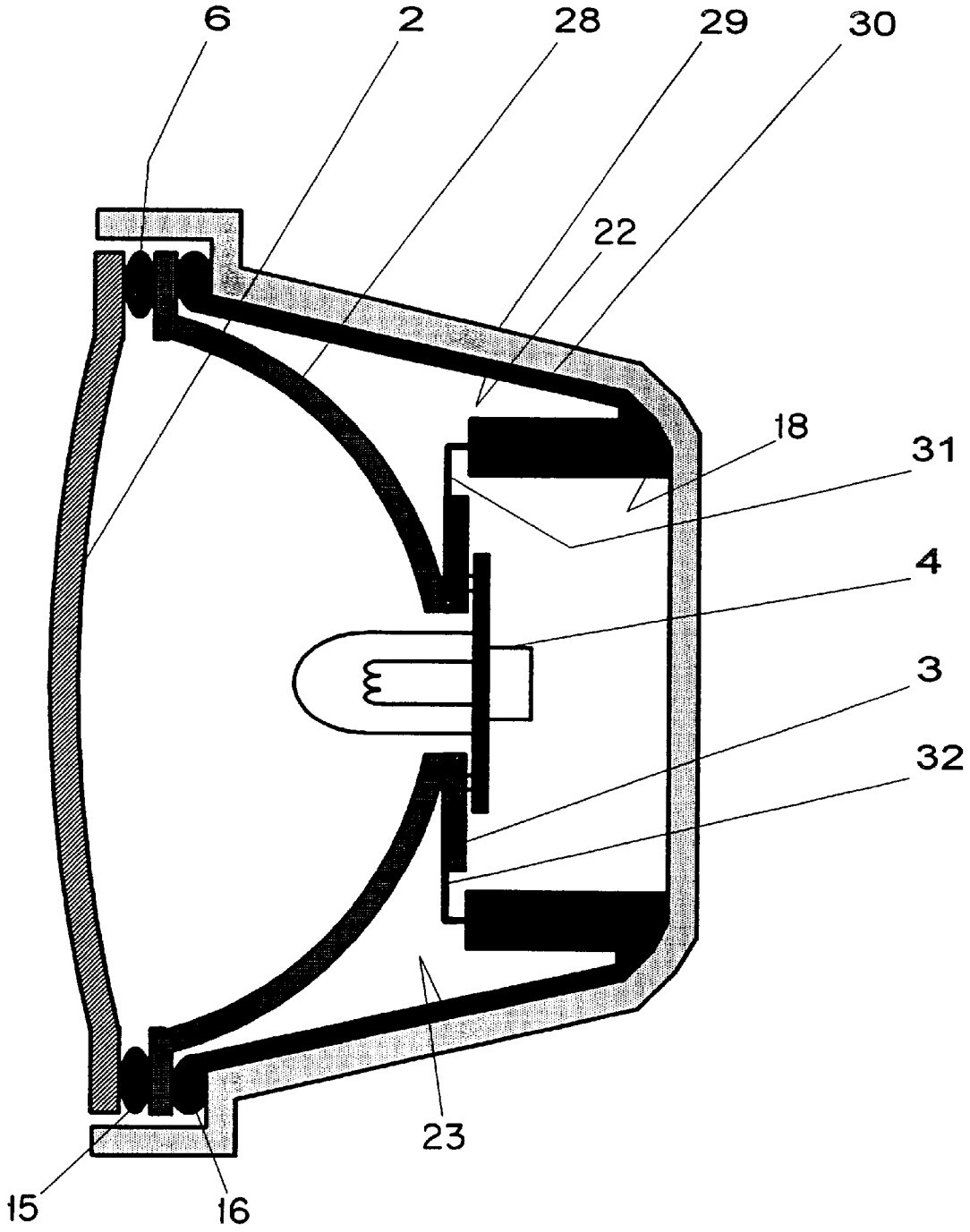
FIG. 4 shows the side view of the lamp unit embodiment according to the invention.

FIG. 4 shows a side view of the lamp unit embodiment according to the present invention. The lamp unit embodiment according to the invention comprises a front glass or lens 2, a seat mean 3 of the bulb, a bulb 4, an outer gasket 6, a reflector 28, a lamp housing part 29, a casting 30 and the protrusions 31, 32 of the bulb seat mean.

Figure 5:
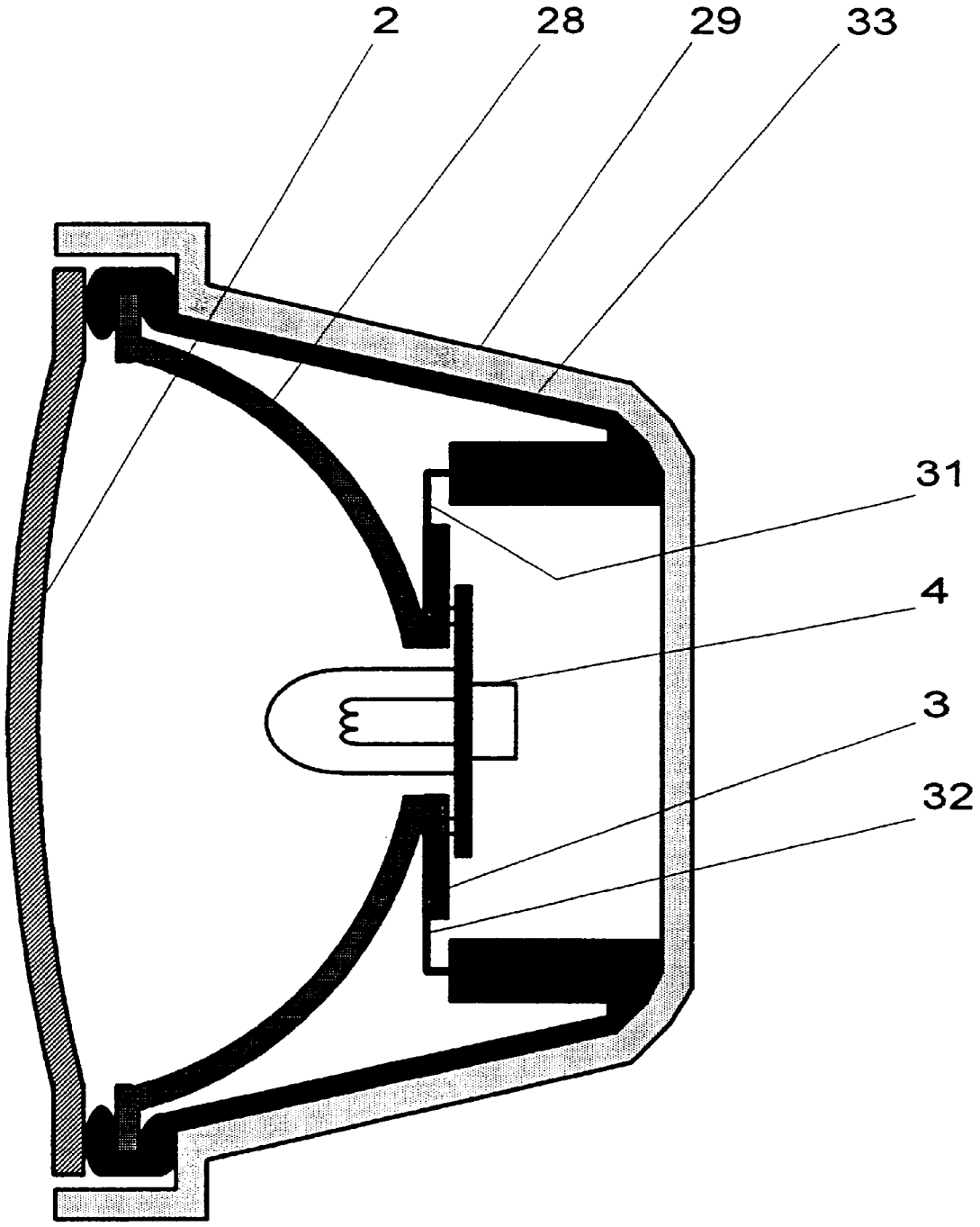
FIG. 5 shows the side view of an alternative lamp unit embodiment according to the invention.

FIG. 5 shows a side view of an alternative lamp unit embodiment according to the invention. The alternative lamp unit embodiment according to the invention comprises a front glass 2, a seat mean 3 of the bulb, a bulb 4, a reflector 28, a lamp housing part 29, a casting 33 and the protrusions 31, 32 of the bulb seat mean. In the alternative lamp unit embodiment the outer gasket and the casting 33 are combined.

The vibration proof lamp unit embodiment according to the invention comprises an outer lamp housing 29, a front glass 2, a reflector 28, a bulb 4, an outer gasket 15, 6, a casting 16, 30, 33, vibration absorbing support posts 17–20, a seat mean 21, 3 of the bulb, casting channels 22, 23 and protrusions 24–27, 31–32 of the bulb seat mean.

The vibration proof lamp unit embodiment according to the present invention is characterized in that the seat mean 21, 3 of the bulb is assembled into the mould so that the protrusions 24–27, 31–32 of the bulb seat mean remain between the frames of the mould, after which the mould is sunk to the right depth into the lamp housing. The protrusions 24–27, 31–32 of the bulb seat mean, which remain between the mold frames, can e.g. be flat pins or alternatively narrow strips made of cloth. After this the mould is injected or cast with the desired mass, e.g. silicone, india rubber or synthetic rubber. The mass 16, 30, 33 injected or cast this way forms through the casting channels 22, 23 the vibration absorbing support posts 17–20. The seat mean 21, 3 of the bulb is also vulcanized fast to the lamp housing with the help of the protrusions 24–27, 31–32 of the bulb seat mean. The vibration absorbing support posts 17–20 are thus cast fast both to the lamp housing and to the seat mean 21, 3 of the bulb.

In the vibration proof lamp unit according to the present invention the vibration absorbing support posts 17–20 form a link between the seat mean 21, 3 of the bulb 4 and the outer lamp housing 29. The vibration proof lamp unit according to the present invention can have a hole, a pin or a bump on the side of the bottom part of the outer lamp housing 29 in order to ensure better adhesiveness.

In the method according to the present invention the vibration proof lamp unit can be manufactured so that the gasket of the reflector 28 and the outer lamp housing 29 are cast at the same time through the connecting cast channel 22, 23 in a mould which is open toward the outer lamp housing 29. In the method according to the present invention the two separate phases of manufacturing have been combined into one phase.

In the method according to the present invention the a vibration proof lamp unit can be manufactured so that the outer gasket 15, 6 of the reflector 28, outer lamp housing 29 and front glass 2 are cast simultaneously through the connecting cast channel 22, 23 in a mould, which is open toward the outer lamp housing 29. In the method according to the present invention the vibration proof lamp unit is manufactured so that the vibration damping of the bracket outside the lamp housing 29, which connects the lamp unit to the frame of the vehicle can be cast simultaneously with the same or a different compound.

In the method according to the present invention the vibration proof lamp unit is manufactured so that the seat means 21, 3 of the bulb is vulcanized directly into the lamp housing into its final place. In the method according to the present invention the mould is open toward the outer lamp housing 29 so that casting channels 22, 23 are formed between different parts of the lamp unit, e.g. between vibration absorbing support posts 17–20 and gaskets. The casting can be done simultaneously using one or several cast compounds. In the method according to the invention the gasket can be cast fast simultaneously and also the connector itself can be made of rubber.

The lamp unit embodiment according to the invention can be used to remove the problem of vibration but in such a way that heating cannot correspondingly deteriorate the reliability of the lamp unit.

The lamp unit embodiment according to the invention can be utilized e.g. as headlights or additional lights on different kind vehicles, such as cars, busses, trucks, farm tractors, aeroplanes or on other mobile devices.

What is claimed is:

1. A vibration proof lamp unit comprising:

A) an integrally molded unit including:

A1) an outer housing open at a forward end thereof, and

A2) an inner unit affixed inside the outer housing and including:

A2i) a bulb seat including a bulb-support portion and protrusions projecting outwardly therefrom, and A2ii) a one-piece cast member integrally molded to an inner surface of the outer housing and including vibration absorbing portions molded to the protrusions, and an inner gasket disposed forwardly of the bulb seat, and A3) a bulb mounted to the bulb-support portion and disposed inside the outside housing, B) a reflector attached to the integrally molded unit, wherein a rear portion of the reflector is disposed rearwardly of the bulb, and a front portion of the reflector is disposed forwardly of the bulb and bears against the inner gasket, and C) a lens mounted to the integrally molded unit in front of the reflector and bearing against an outer gasket disposed between the lens and the reflector.

2. The lamp unit according to claim 1 wherein the outer gasket is integral with the inner gasket.

3. The lamp unit according to claim 1 wherein the outer gasket is separate from the inner gasket.

4. The lamp unit according to claim 1 wherein the bulb seat is connected to the one-piece cast member solely at the protrusions.

5. The lamp unit according to claim 4 wherein the vibration absorbing portion comprises a plurality of posts having respective rear ends integrally molded to the inner surface of the housing and extending forwardly therefrom toward the protrusions.

6. The lamp unit according to claim 1 wherein the cast member comprises silicone.

7. The lamp unit according to claim 1 wherein the cast member comprises india rubber.

8. The lamp unit according to claim 1 wherein the cast member comprises synthetic rubber.

9. The lamp unit according to claim 1 wherein the outer housing has a hole formed therein to enhance the molded connection to the cast member.

10. The lamp unit according to claim 1 wherein the outer housing has a pin therein to enhance the molded connection with the cast member.

11. The lamp unit according to claim 1 wherein the outer housing has a bump thereon to enhance the molded connection with the cast member.

12. A method of manufacturing a vibration proof lamp unit comprising the steps of:

A) forming an integrally molded unit by:

A1) positioning a bulb seat in a mould, the bulb seat including a bulb-support portion and protrusions extending therefrom and disposed between frames of the mould;

A2) descending the mould into the outer housing;

A3) introducing casting material into the mould to form a vibration absorbing portion integrally molded to an inner surface of the outer housing and connected to the protrusions; and B) attaching a reflector and a lens to the integrally molded unit.

13. The method according to claim 12 wherein the protrusions comprise flat pins.

14. The method according to claim 12 wherein the protrusions comprise cloth strips.

15. The method according to claim 12 wherein step A3 includes forming a gasket from the casting material that is integral with the vibration absorbing portion, with the gasket disposed between the reflector and the outer housing.

16. The method according to claim 12 wherein step A3 includes forming two gaskets from the casting material that are integral with the vibration absorbing portion, one of the gaskets disposed between the reflector and the outer housing, and the outer gasket disposed between the lens and the reflector.

17. The method according to claim 12 wherein step A3 includes forming a vibration isolator of a bracket disposed outside of the outer housing.

18. The method according to claim 12 wherein step A3 comprises using only one casting compound.

19. The method according to claim 12 wherein step A3 comprises using a plurality of different casting compounds.

* * * * *